US005135193A

United States Patent [19]

Parris

[11] Patent Number: 5,135,193

[45] Date of Patent: Aug. 4, 1992

[54] TRAY FOR HOLLLOW-RUNG LADDERS

[76] Inventor: Thomas Parris, 4935 Steeple Dr., Greendale, Wis. 53129-2012

[21] Appl. No.: 684,771

[22] Filed: Apr. 15, 1991

[51] Int. Cl.[5] ..... E06C 7/14
[52] U.S. Cl. ..... 248/238; 182/129
[58] Field of Search ..... 182/129; 248/238, 210

[56] References Cited

U.S. PATENT DOCUMENTS

| | | | |
|---|---|---|---|
| 4,445,659 | 5/1984 | LaChance | 248/210 |
| 4,660,794 | 4/1987 | Given | 248/238 |
| 4,662,594 | 5/1987 | Dubis | 248/238 |
| 4,702,446 | 10/1987 | Brown | 248/210 |
| 4,824,060 | 4/1989 | Korda | 182/129 |
| 4,949,925 | 8/1990 | Gorecki | 182/129 |
| 5,031,723 | 7/1991 | Hooten | 248/238 |

OTHER PUBLICATIONS

Can-Do Can Holder, p. 27 of The Family Handyman, Jul./Aug. 1989.

*Primary Examiner*—Reinaldo P. Machado

[57] ABSTRACT

This invention is a tray that attaches to the side of hollow-rung ladders. The tray is sized large enough to accommodate an industry standard paint-roller-pan and hold it in a convenient position for the user either at the left side or at the right side of the ladder. The tray mounts to the ladder via a shaft that passes thru one hollow-rung. Secure attachment to various width ladders is accomplished via a safety-clip inserted into one of the series of thru-holes in the free end of the shaft that extends thru the hollow-rung. Adjustment of the tray to horizontal is accomplished via a movable L-shaped support that penetrates into a second hollow-rung. This invention contains fewer and simpler parts in comparison to prior inventions.

1 Claim, 4 Drawing Sheets

TRAY FOR HOLLLOW-RUNG LADDERS

BACKGROUND OF THE INVENTION

Working on extension ladders has been inefficient with inadequate methods for holding tools and materials in a convenient productive location. This awkward work environment causes workmanship problems and requires an excessive number of time and energy consuming trips back down and up the ladder in order to bring up additional tools or materials.

Popular methods of attaching items to extension ladders consist of various designs of double-ended hooks where the upper hook fits over a ladder rung and the lower hook supports the handle of a pail; or the lower hook is inserted thru a ring attached as an integral part of a tool. Special purpose straps, ropes, wires and chains are often used to attach items to extension ladders.

Special belts, pouches and pockets designed to fit around the waist of the ladder user are also popular for holding items. And recently, there have been tote boxes designed to fit onto ladder rungs.

Paint-roller-pans are designed to sit upon flat surfaces; or hang onto the thin flat treads of stepladders. The L-shaped tabs which are formed into the two rear feet of the paint-roller-pan hook under the rear edge of the flat tread of the stepladder; which allows gravity to pull downward upon the front of the paint-roller-pan thereby holding it in position. Therefore, the higher productivity method of applying paint with rollers and paint-roller-pans have been restricted to use at ground level; or to use on shorter stepladders or on scaffolding.

Unlike extension ladders, the typical stepladder has a fold-down shelf as an integral part of its design. And the top of a typical stepladder is wider than its treads; so that it also may be used as a small shelf.

The most common type of extension latter available today is fabricated from cut pieces of aluminum extrusions; the steps or rungs are usually fabricated from hollow tubular-like pieces. The distance between rungs is a standard dimension with manufacturers in the United States of America. The inside diameters of the tubular rungs from various manufacturers have very small dimensional variations.

Prior inventions of tray attachments to extension ladders are numerous and most are time consuming to attach and adjust. Most have been market-place failures because of the large number of components and/or the complexity of the components. Some have been market-place failures because they are hazardous. My invention is similar in function to U.S. Pat. No. 4,445,659 awarded to LaChance which is the most practical to attach and adjust of the numerous prior inventions. The LaChance Patent demonstrates more then twenty components. My invention has only ten components seven of which are standard hardware store items. My invention is light-weight which minimizes ladder stability problems. My invention uses an electrically nonconductive material for the tray which makes it less hazardous when used near electrical apparatus.

BRIEF SUMMARY OF THE INVENTION

This invention is a method of attaching a tray or shelf onto a typical commercially available hollow-rung extension ladder. Henceforth this attachment will be called a tray. This tray may be used to hold a variety of items in order to improve the productivity and workmanship of the ladder user. The means of attachment for this invention will acommodate a variety of ladder widths. The tray has an angular adjustment so that it may be attached at the right side or the left side of the ladder whichever is the most convenient loction for the user. The means of attachment of this invention is secure so that it cannot disengage from the ladder and become dangerous. The means of attachment is secure so that the tray cannot rotate and dump its contents. The means of angular adjustment will allow the tray to be made horizontal so that items placed upon it do not slide, roll or overflow.

This invention has three unique major physical components: the tray 10, the shaft 20, and the support 30. The remaining components are standard commercially available hardware items.

DETAILED DESCRIPTION

Figure 1:
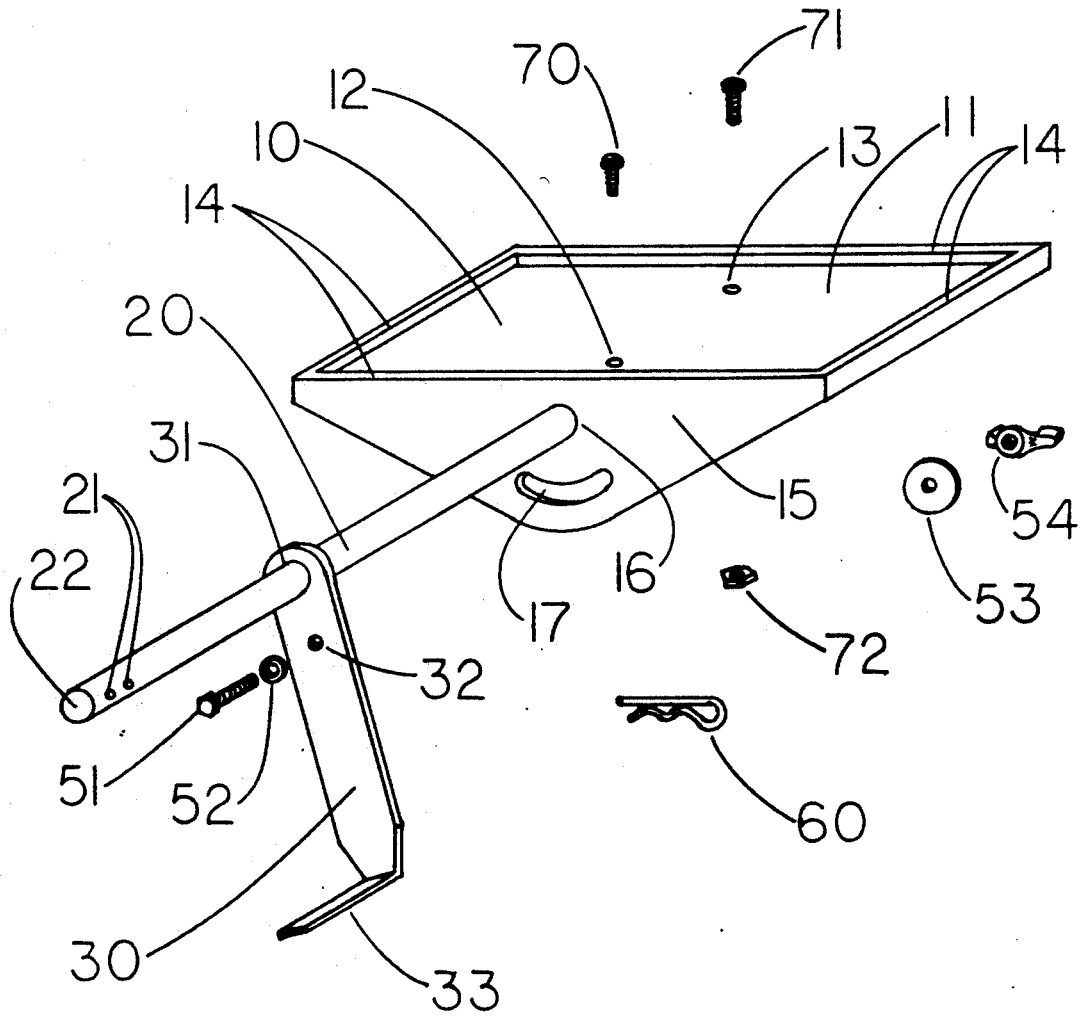
FIG. 1 is an exploded view of all of the components of this invention.
Figure 2:
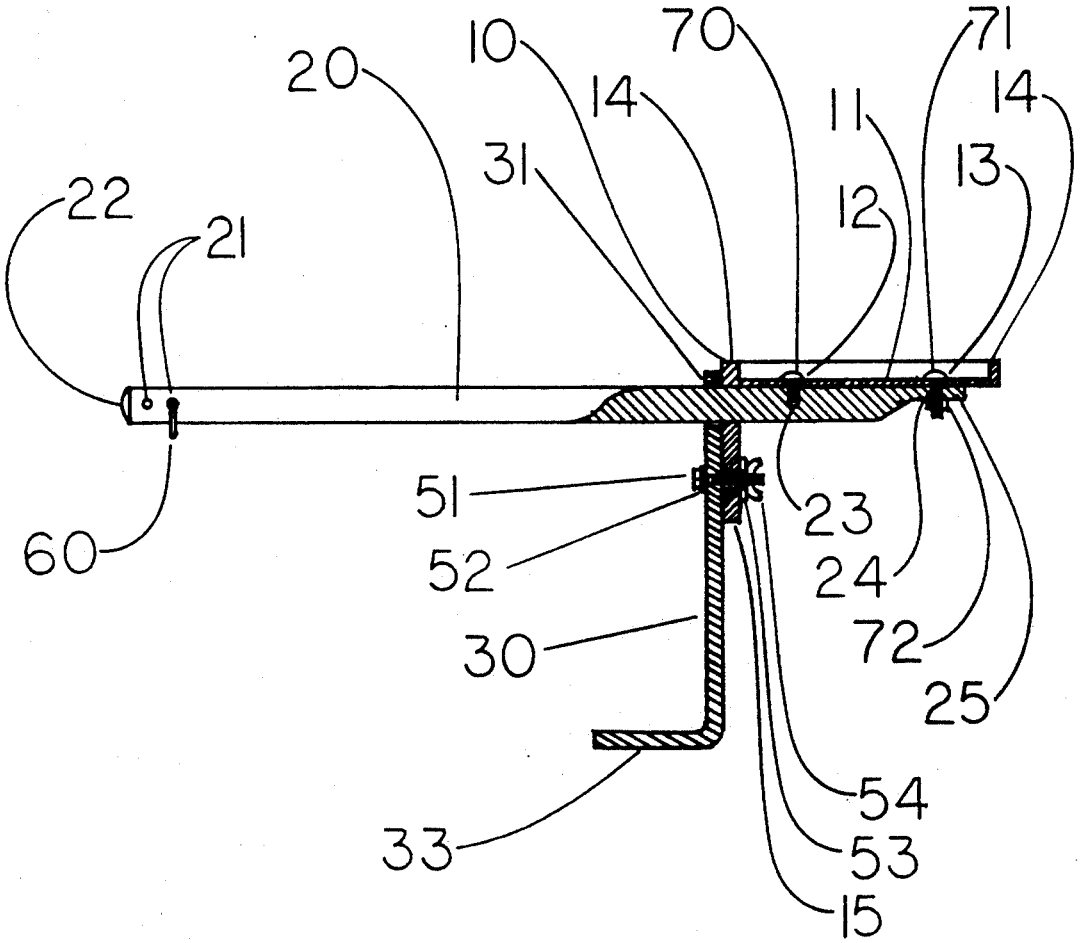
FIG. 2 is a cross sectional view thru the long axis of the components shown in FIG. 1.
Figure 3:
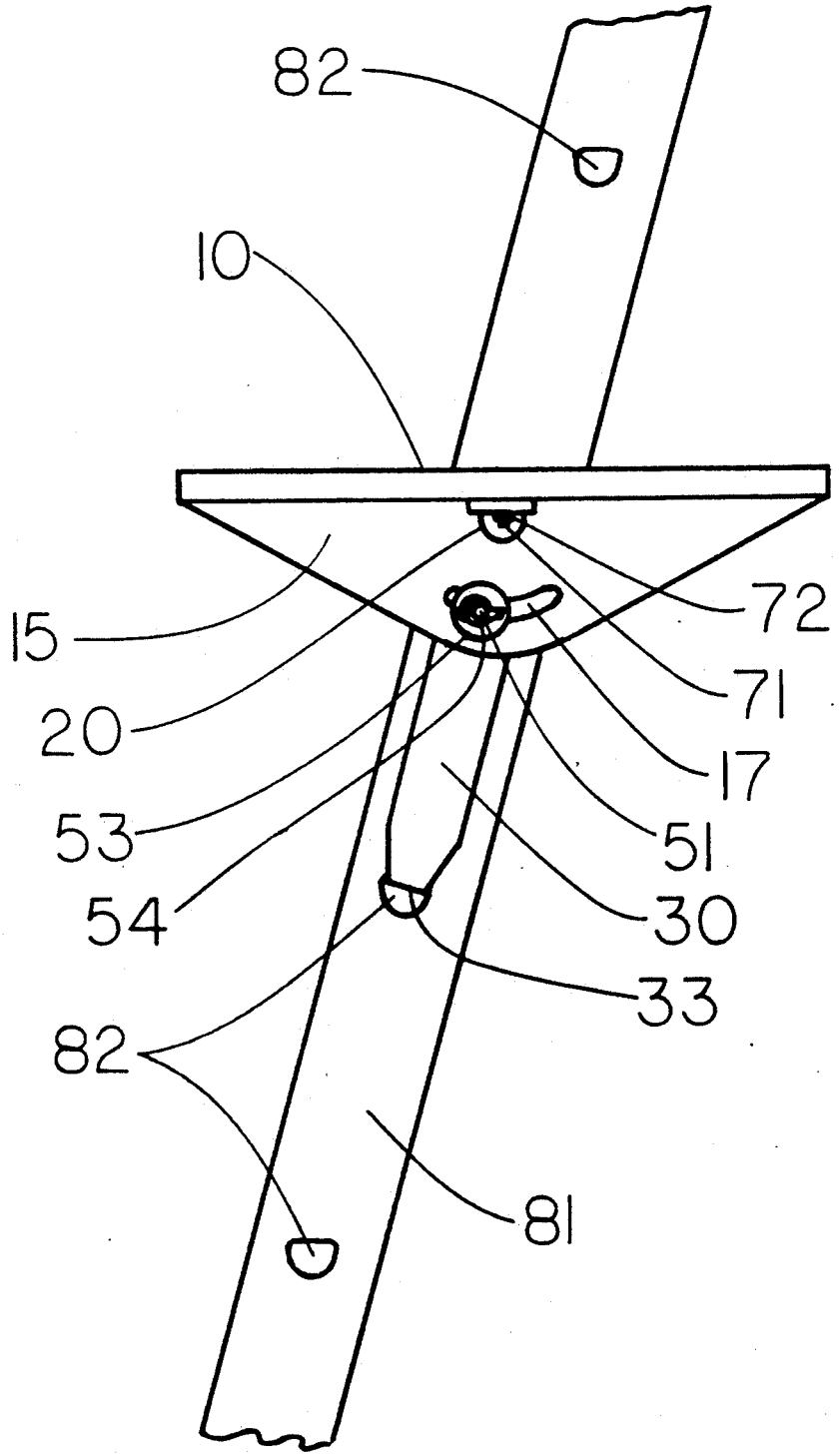
FIG. 3 shows the invention attached to the right side-rail of a typical hollow-rung extension ladder. It is a side view of the right side-rail of the extension ladder and an end view of the tray. This view shows the extension ladder at an inclined angle of 75½ degrees from the horizontal, which is the angle recommended by industry safety standards.

The tray 10 shown on FIG. 1, FIG. 2 and FIG. 3 has a raised edge 14 around the rectangular perimeter. The size of the flat horizontal storage surface 11 of the tray 10, inside the raised edge 14, is a minimum of 27 centimeters wide by 38 centimeters deep (which is large enough to hold a typical commercially available paint-roller-pan). The 27 centimeter minimum width is the dimension parallel to the shaft 20. The tray 10 is shown in its preferred implementation as a one-piece molding of electrically nonconductive thermoplastic. A geometrically identical tray 10 was fabricated from multiple pieces of wood and plywood that were screwed and glued together. A geometrically equivalent tray 10 was also been fabricated from a single piece or corrosion protected sheet metal that was cut to a specific outline and subsequently folded (edges up and down-leg down) into the configuration shown. All three methods of fabrication (one-piece molding, multiple piece assembly, and folded sheet metal) are geometrically identical and are therefore functionally equivalent.

The tray 10 shown on FIG. 1 and FIG. 2 has thru clearance holes 12 and 13 which are used to receive screws 70 and 71. The screws 70 and 71 are the rpeferred implementation of rigidly attaching the tray 10 to the cylindrical shaft 20. Other methods such as riveting, welding, glueing, or bonding are equivalent methods for rigidly connecting these two components into the identical geometric shape. Regardless of which method is used, it is absolutely necessary to rigidly connect the tray 10 to the shaft 20 in order for this invention to function properly.

The tray 10 has a down-leg 15. The preferred implementation of the down-leg 15 is shown as an integral part of the tray 10; a geometric equivalent is to use a separate piece that is rigidly attached to the tray 10 via mechanical hardware or welding. This down-leg 15 has a round thru hole 16 plus a thru worm-hole 17. The round thru hole 16 is slightly larger than the diameter of the shaft 20 so that it receives the shaft 20 and provides a means of locting the shaft 20 relative to the tray 10 during assembly. The worm-hole 17 is slightly wider than the outside diameter of the bolt 51 so that there is interference free clearance as the support 30 is rotated about the shaft 20. The worm hole 17 has a length that is dimensioned so that the support 30 may pivot about the shaft 20 for a minimum of plus or minus 20 degrees from the vertical while the tray 10 is held horizontal. Both of the long sides of the worm hole 17 are radii with the center of both radii being the center of the round thru hole 16.

An alternative to the worm-hole 17 is to replace it with two clearance holes. One clearance hole for use in mounting this invention on the ladder's seft side and the other for use in mounting on the ladder's right side. Each clearance hole is located at a geometric position formerly occupied by the extremes of the worm-hole 17. The diameters of these two clearance holes is dimensioned to allow a plus or minus 5 degree angle adjustment of the tray 10 to horizontal.

The cylindrical shaft 20 may be solid or tubular; both configurations are geometric equivalents with safety, weight and cost being the criteria for the preferred implementation of the invention. The preferred implementation uses electrically nonconducting fiberglass tubing material for the shaft 20 in spite of the fact that the lowest cost practical material is corrosion protected thin-wall metal tubing. The outside diameter of the shaft 20 is sized to fit freely inside the hollow-rung 82 of the extension ladder. The shaft 20 has a minimum of two thru cross holes 21 near the free end 22; these cross holes 21 are slightly larger in diameter than the wire diameter of the safety-clip 60 in order to freely receive said safety-clip 60. The axes of the cross holes 21 are perpendicular to the axis of the shaft 20. Hole 23 is sized to receive thread-cutting screw 70; and hole 24 is sized to receive machine screw 71 as the preffered method of rigidly attaching the shaft 20 to the tray 10. The flattened end 25 on the shaft 20 is an optional means of attaining additional rigidity. The free end 22 of the shaft 20 is smooth and rounded for safety reasons; an elastomer end-plug is used when the shaft 20 is thin-wall metal tubing.

The support 30 shown on FIG. 1, FIG. 2 and FIG. 3 is a single L-shaped piece fabricated from corrosion protected sheet metal. The support 30 has a thru hole 31 that fits over the shaft 20 witha small amount of clearance. The width of the L-tab 33 is sized to fit freely inside the hollow rung of the extension ladder. The support 30 shown has a screw-threaded thru hole 32 to receive a screw-threaded bolt 51 with a lock-washer 52. A less preferred geometric equivalent is to use a screw-threaded stud that is welded at the same location as the bolt 51. This less preferred physical implemention of the design concept eliminates the lock-washer 52 and the threading of the hole 32 but is considerably more difficult to repair. Regardless of the method used, the screw-threaded bolt 51 must be rigidly attached to the support 30 in order for the invention to function properly.

Figure 4:
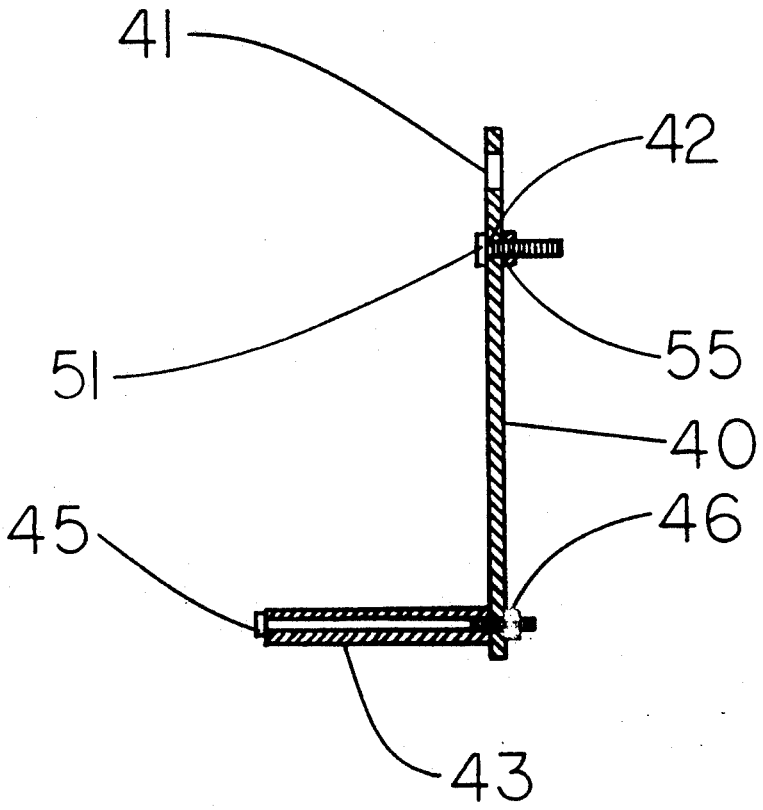
FIG. 4 is a cross sectional view of a second method of fabricating the support.

A functionally equivalent support 40 fabricated from a rectangular piece of sheet metal, plywood, or plastic is shown on FIG. 4. Instead of the L-tab 33, this straight support has a rigid bolted-on, or welded-on, hollow cylinder 43 that has the same outside diameter as the shaft 20. The hollow cylinder 43 is rigidly attached to the support 40 with the long screw-threaded bolt 45. The bolt 45 is inserted thru the hollow cylinder, then thru the clearance hole 44 in the support 40, and then secured into place with screw-threaded nut 46. This support 40 design has a thru clearance hole 42 to receive screw-threaded bolt 51 which is rigidly attached with screw-threaded nut 55. The thru hole 41 is sized to fit freely over the shaft 20 with a small amount of clearance.

The preferred implementation of the safety-clip 60 shown on FIG. 1 is a standard commercially available hardware item called a hitch-pin; its function is to lock into positin thru one of the cross holes 21 in the shaft 20 in order to secure the assembly onto the ladder. The shaft 20 is inserted thru the hollow-rung 82 and out the opposite side of the ladder. After the safety-clip 60 is inserted thru the appropriate cross hole 21 in the shaft 20, the tray attachment assembly cannot be withdrawn or disengaged from the ladder until the safety-clip 60 is removed. Themultiple cross holes 21 accomodate ladders of various widths. Commercially available hardware items that are less practical yet functional equivalents to the hitch-pin safety-clip 60 are: cotter-pins, a bolt with a nut, wire shower-curtain clips, or a suitable proprietary clip. Any functional safety-clip 60 must fit thru a cross hole 21, be longer than the inside diameter of the hollow-rung 82, have sufficient strength to resist physical damage, and securely lock into position so that cannot be accidently dislodged.

The large flat washer 53 plus the screw-threaded wing-nut 54 are essential items that are standard commercial hardware items made of corrosion protected metal; they fit onto the bolt 51. An internal screw-threaded knob is a functional equivalent to the wing-nut 54. In the complete assembly, the function of the washer 53 and the wing-nut 54 is to clamp the support 30 or 40 against the down-leg 15 of the tray 10. The washer 53 and wing-nut 54 used in conjunction with the design configuration and other components give a means of adjusting the tray assembly to a horizontal position along with the angular adjustment necessary for mounting on the right side or left side of the ladder. In order to hold the horizontal positin of a loaded tray 10 with a small amount of torque used to tighten the wing-nut 54, the surface finishes on the down-leg 15 are roughened; and the washer 53 hs one face, the face assembled against the down-leg 15, coated with rubber in order to yield a high coefficient of friction.

Prior to its use, the tray assembly shown in FIG. 1 is put together from the components described in the preceeding paragraphs. First, the shaft 20 is inserted thru the hole 16 in the down-leg 15 of the tray 10; then the shaft 20 is rigidly attached to the tray 10 with the two screws 70 and 71 plus the screw-threaded nut 72. Second, the L-shaped support 30 is assembled with the screw-threaded bolt 51 and lock-washer 52 to create the support subassembly. Third, the hole 31 in the support assembly is slipped over the free end of the shaft 20 and moved up against the down-leg 15 of the tray 10 such that the bolt 51 protrudes thru the worm-hole 17. Last, the washer 53 (rubber side toward the down-leg 15) and the wing-nut 54 are threaded over the bolt 51 and tightened by hand. The tray assembly is then complete and ready for use.

The tray assembly attaches to hollow-rung ladders for the purpose of holding tools and materials in order to improve user productivity. The protruding shaft 20 passes thru the hollow-rung 82 of the ladder and out the opposite side as the primary means of attachment. The hollowness and openendedness of the hollow-rung 82 are a long mounting hole thru which the protruding shaft 20 passes. The downleg 15 of the tray 10 and the L-shaped support 30 act similar to the head on a bolt that limit the movement into the hollow-rung 82. One of the cross holes 21 at the free end of the shaft 20 which projects out the opposite side of the hollow-rung 82 receives the safety-clip 60 which when properly inserted prevents the tray assembly from being withdrawn from the rung as would a nut on the end of a bolt.

The plurality of cross holes 21 at the free end of the shaft 20 which protrudes out the opposite side of the hollow-rung 82 give a means of securing the tray assembly to ladders of various widths. The in/out movement of the tray assembly is minimized by inserting the safety-clip 60 into the exposed cross hole 21 that is closest to the adjacent side-rail 81 of the ladder.

When the tray assembly is attached to the hollow-rung ladder, the protruding L-tab of the support 30 prevents the rotation of the tray 10 about the hollow-rung 82 into which the shaft 20 has been inserted. This L-tab fits into the hollow-rung 82 of the ladder that is the rung immediately below the rung into which the protruding shaft 20 of the tray assembly has been inserted. When the L-shaped support 30 is firmly secured to the downleg 15 of the tray 10 with the bolt 51, washer 53, and wing-nut 54, the tray assembly acts like a two-tanged fork that fits into two adjacent hollow ladder rungs.

Since the support 30 pivots freely about the protruding shaft 20 and locks into position with the washer 53 and wing-nuts 54, the tray 10 may be adjusted to horizontal regardless to which ladder side-rail 81 it is mounted. This angular adjustment means also accommodates variations in the ladder-to ground leaning-angle.

Thus having described my invention, I claim:

1. A work tray and adjustable support combination for attachment to hollow-rung ladders comprising:

a. a shaft serving as a ladder attachment means;

b. said shaft being long enough to extend thru one ladder hollow-rung to expose at least one of a plurality of thru cross holes at the exposed end;

c. said shaft exposed cross hole nearest the ladder side-rail receiving a safety-clip in order to provent said shaft from accidental disengagement from the ladder hollow-rung;

d. said shaft having two thru cross holes at the opposite end that receive two thread cutting screws so as to rigidly attach a tray to said shaft;

e. a tray having a rectangularly shaped flat horizontal storage surface with four raised edges at the perimeter;

f. said tray having two thru clearance assembly holes on the centerline of the storage surface that match up with the location of the two thru assembly cross holes in said shaft;

g. said tray having a down-leg at one edge extending downward at a ninety degree angle from the storage surface and at an angle of ninety degrees to the axis of said assembled shaft;

h. said tray downleg having parallel flat surfaces with a round thru hole to accommodate said protruding assembled shaft plus a worm shaped thru hole for receiving the screw-threaded bolt on an L-shaped support;

i. said tray down-leg worm hole having the two long edges as radii extending from the center of the round thru hole accommodating said assembled shaft;

j. an L-shaped support having a round thru pivot hole at the top end receiving said shaft;

k. said L-shaped support having a threaded screw hole at the center section receiving a screw-threaded bolt;

l. said L-shaped support having a tab at the bottom end being at an angle of ninety degrees to the main section;

m. said L-shaped support tab being inside and at the centerline of the hollow-rung adjacent to the hollow-rung receiving said shaft;

n. said L-shaped support screw-threaded bolt extending thru the worm hole insaid tray down-leg in order to receive a rubber faced flat washer plus an internal screw-threaded wing-nut such that the wing-nut may be tightened and loosened to allow said tray to pivot about said L-shaped support adjusting the relative angular position of said tray to the ladder.

* * * * *